US006666744B2

(12) United States Patent
Llorens

(10) Patent No.: US 6,666,744 B2
(45) Date of Patent: Dec. 23, 2003

(54) DOLL THAT REACTS TO THE VOICE AND TO CARESSING BY LAYING DOWN OR SITTING UP

(75) Inventor: Jaime Ferri Llorens, Alicante (ES)

(73) Assignee: Onilco Innovacion, S.A., Alicante (ES)

( * ) Notice: Subject to any disclaimer, the term of this patent is extended or adjusted under 35 U.S.C. 154(b) by 79 days.

(21) Appl. No.: 10/003,760

(22) Filed: Nov. 14, 2001

(65) Prior Publication Data

US 2002/0137426 A1 Sep. 26, 2002

(30) Foreign Application Priority Data

Mar. 23, 2001 (ES) ..... 200100690

(51) Int. Cl.[7] ..... A63H 3/00
(52) U.S. Cl. ..... 446/268; 446/353
(58) Field of Search ..... 446/268, 353, 446/354, 298, 325, 330, 175, 176, 183, 199

(56) References Cited

U.S. PATENT DOCUMENTS 2,596,491 A * 5/1952 Kinberg
2,906,059 A * 9/1959 Berger
2,990,646 A * 7/1961 Berger
3,036,404 A * 5/1962 Berger
3,568,362 A * 3/1971 Tomaro
4,249,338 A 2/1981 Wexler
5,236,385 A * 8/1993 May ..... 446/300
6,506,095 B1 * 1/2003 Lund et al. ..... 446/353

* cited by examiner

*Primary Examiner*—Derris H. Banks
*Assistant Examiner*—Jamila O Williams
(74) *Attorney, Agent, or Firm*—John C. McMahon

(57) ABSTRACT

It consists of an electric motor (1) which by means of a reducer activates a central gear (12) that transmits the movement to a central wheel (20) that on each one of its sides has matching channels (21), where a pair of knobs (22) are housed comprising two oscillating levers (23) that can rotate around an articulation axle (24) near the doll's (1) shoulders, with each oscillating lever (23) ending in an oscillating toothed area (25) which gears into a toothed circular area (26) united rotationally to the legs (6) of the doll (1).

The electric motor (11) receives its supply either by means of a circuit controlled by the contacts of a general relay (52) where an off switch in laying down position (27) and an off switch in seated position (28) are looped, or by means of an alternative switch (56) belonging to an alternative relay (55) activated by a microphone (36) that reacts to exterior sound or touch stimulations. FIGS. 6 and 13.

6 Claims, 8 Drawing Sheets

DOLL THAT REACTS TO THE VOICE AND TO CARESSING BY LAYING DOWN OR SITTING UP

The objective of the present invention is a mechanism for a doll which allows simulating that it reacts to the voice or caresses, adopting one of two alternative positions, laying down or sitting up.

This invention has its application within an industry dedicated to the manufacture of toys, specifically dolls and toy figurines, and in internal mechanisms for their motion.

Dolls are known which react to a variety of stimulations such as that described in U.S. Pat. No. 4,249,338, but this necessitates multiplying the stimulus sensors while at the same time complicating the detection electronics, which affects the reliability and duration of the device while at the same time increasing the manufacturing and assembly costs.

One objective of the present invention is obtaining a doll that reacts to a plurality of stimulations thanks to a single and simple sensor.

Another objective of the present invention is to obtain a doll which reacts adopting one of two alternative positions, laying down or sitting up, without the need of mechanical clutches, and offering the necessary sturdiness to allow handling it without damaging the mechanism.

To obtain the proposed objectives, the doll object of the invention incorporates the following:

An electrical motor.

Control means for turning the electrical motor off.

Control means for turning the electrical motor on.

Means for motion.

The doll object of the invention remains resting in each one of the two alternative stable positions, laying down or sitting up, so that, after some stimulation, it changes its position. The doll reacts when it is spoken to, but a stimulation can also consist of a touch or caressing of any part of its body.

To attain these movements, the doll of the invention has a motion mechanism encased inside its trunk operated by an electrical motor with only one turning direction, fed by batteries located inside the legs, by which these, being heavier than the body, tend to remain motionless resting on the floor, with the doll's trunk being what moves in one or the other direction to attain the laying down or sitting up positions. The electrical motor turns a gear reducer which transmits its movement to a central wheel which has on each one of its sides matching channels arranged to receive the knobs from two oscillating levers arranged at one and the other side of the central wheel and articulated at a point close to the doll's shoulders. Each oscillating lever ends on its lower side, the one farthest from the articulation, in an oscillating toothed part that gears into a toothed circular part connected rotationally to the respective leg. The movement is performed with great smoothness and power thanks to the knob-channel coupling and it can be different for each leg, by each one having associated to it its own side channel on the central wheel.

One of the oscillating levers that was just described acts upon two end-stop switches that turn off the supply to the motor when the oscillating lever reaches the extreme positions corresponding to a completely laying down or completely sitting up position of the doll. In order to take the doll out of these extreme positions the electrical motor is fed in a parallel way to the circuit of the end-stop switches from the stimulation detection electronic board itself by means of short motion impulses. After various motion impulses the oscillating lever will allow both end-stop switches to close, by which the motor will move the doll's trunk to the new resting position. The complete movement will be produced even if there are no exterior stimulations during this time lapse.

The stimulation detection element that is used is a microphone encased in a plastic support fastened securely to the doll's foam rubber body. The output of said microphone is strongly amplified before its input into the detection stage of the electronics, which together with its secure fastening to the dolls' body makes it possible to detect not only sounds produced from speaking to it, but also the sound of touch when caressing any part of its body. In this way the complex and delicate multisensory systems are eliminated, reducing the price.

With the doll object of the invention embodied as has just been described, the following is attained:

A large reserve of energy by using the great volume of the legs to house the batteries; also, their large weight maintains the legs more or less resting on the floor, causing the relative movement of the trunk.

Great power and mechanical sturdiness of the channel-knob mechanism, which is nothing more than an internal cam device in a closed circuit, which allows to handle the doll in any position, without paying special attention to avoid forcing the mechanism.

The dolls' reaction to a great diversity of stimulations, both audible as well as tactile, which enhances the user's fantasy.

And, finally, a simple, sturdy doll with very natural movements and reactions.

These and other characteristics of the invention will be more evident thanks to the description of a preferred embodiment that will be performed next based on the figures enclosed with this description, forming an integrated part of it and wherein with a descriptive and non-limiting nature the following has been represented:

Figure 3:
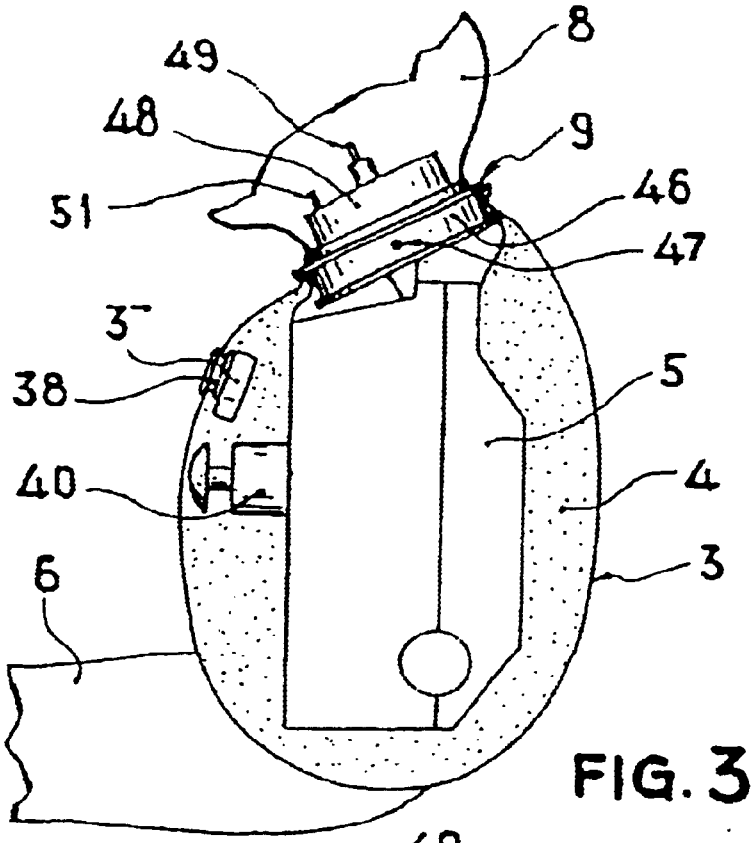
FIG. 3 shows a side-sectional schematic view of the doll of the invention, where the main switch, the detection microphones, the mechanism box and the motion device for the head can be seen.
Figure 4:
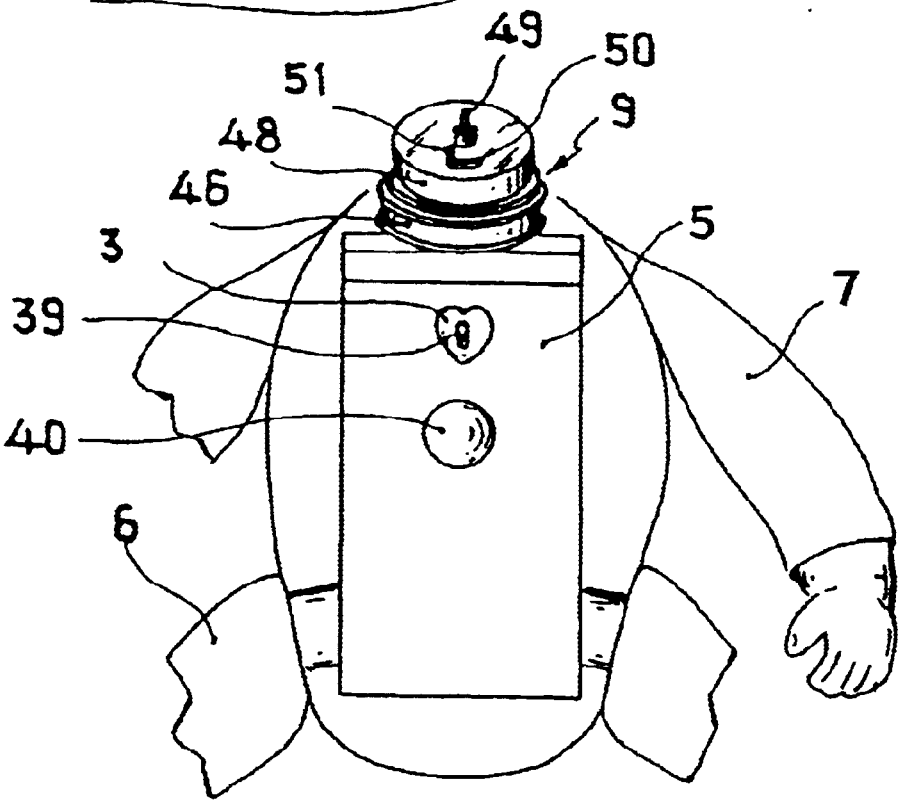

FIG. 4 corresponds to the same FIG. 3, but with a front view.

Figure 5:
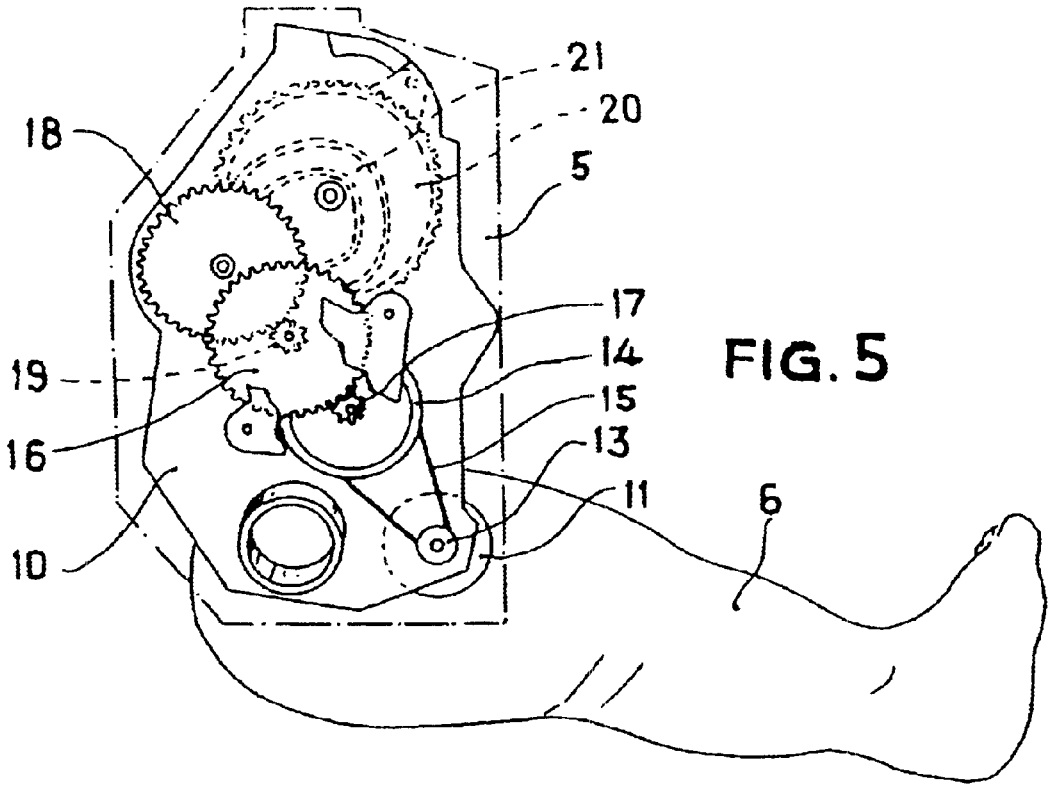

FIG. 5 shows a left side view of the mechanism, with the doll in the seated position.

Figure 6:
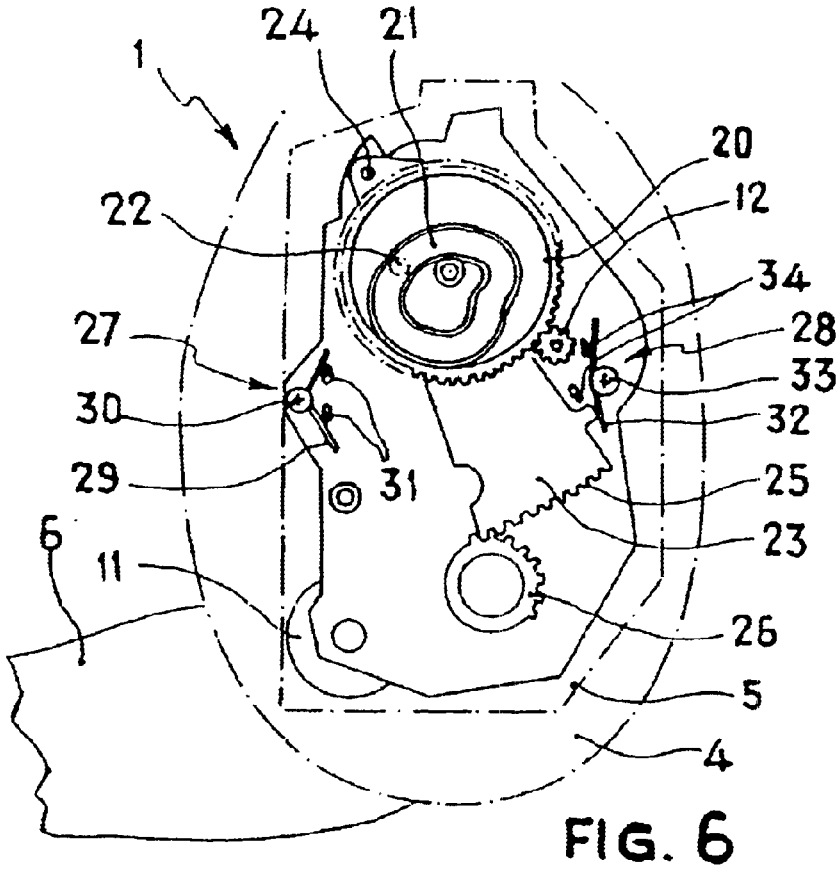

FIG. 6 shows a very schematic right side view of the mechanism, with the doll in the seated position, with one of the oscillating levers removed in order to appreciate the side channel of the central wheel.

Figure 7:
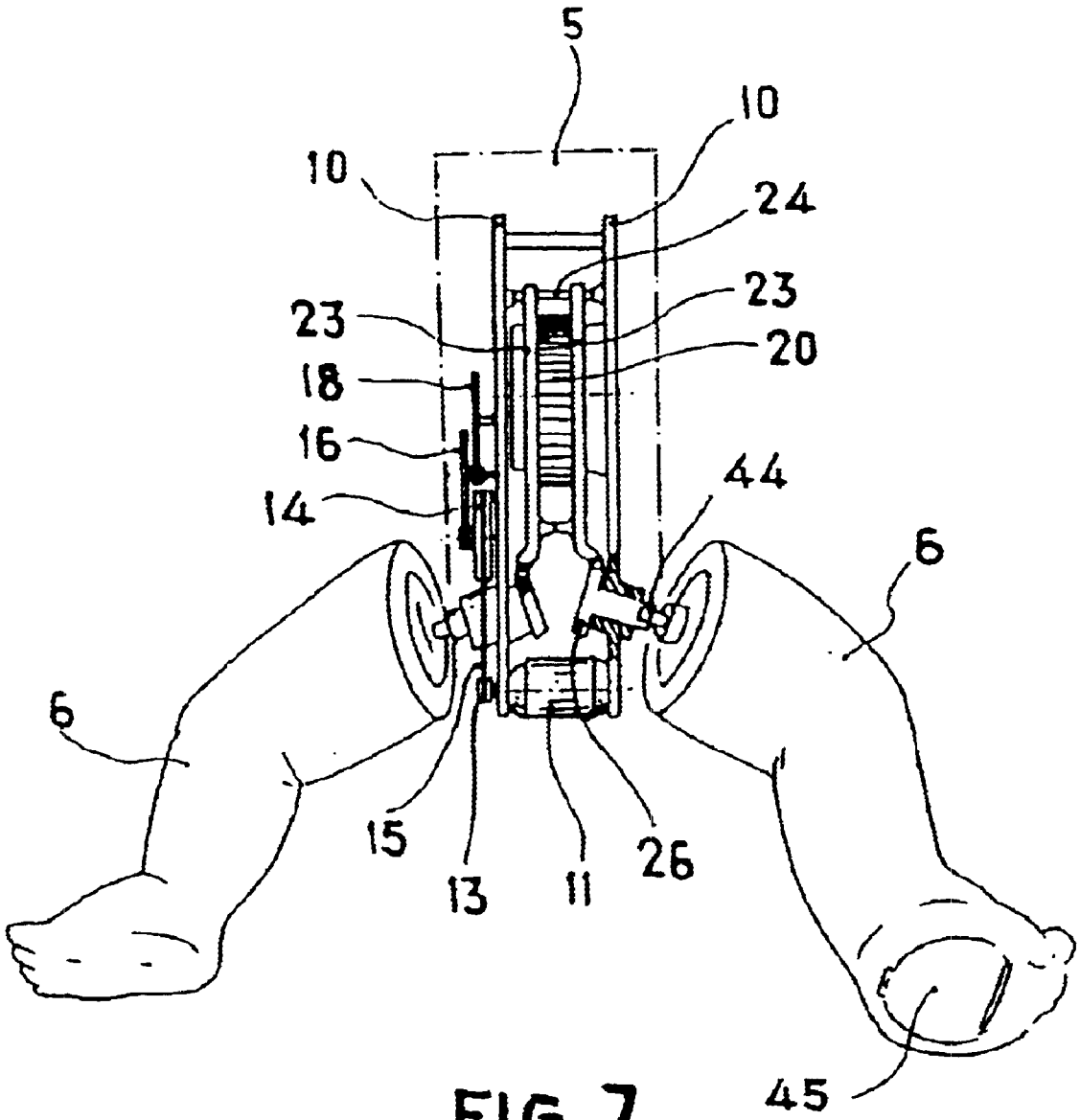

FIG. 7 shows a front view of the mechanism and the doll's legs.

Figure 8:
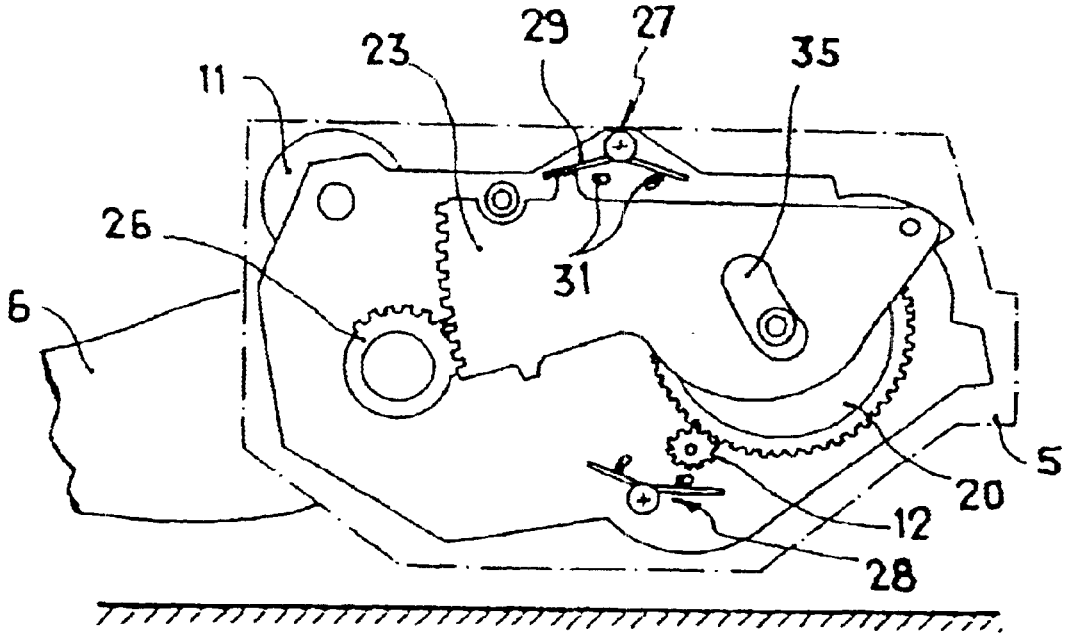

FIG. 8 shows a schematic sectional view of the mechanism, with the doll in the laying down position.

Figure 9:
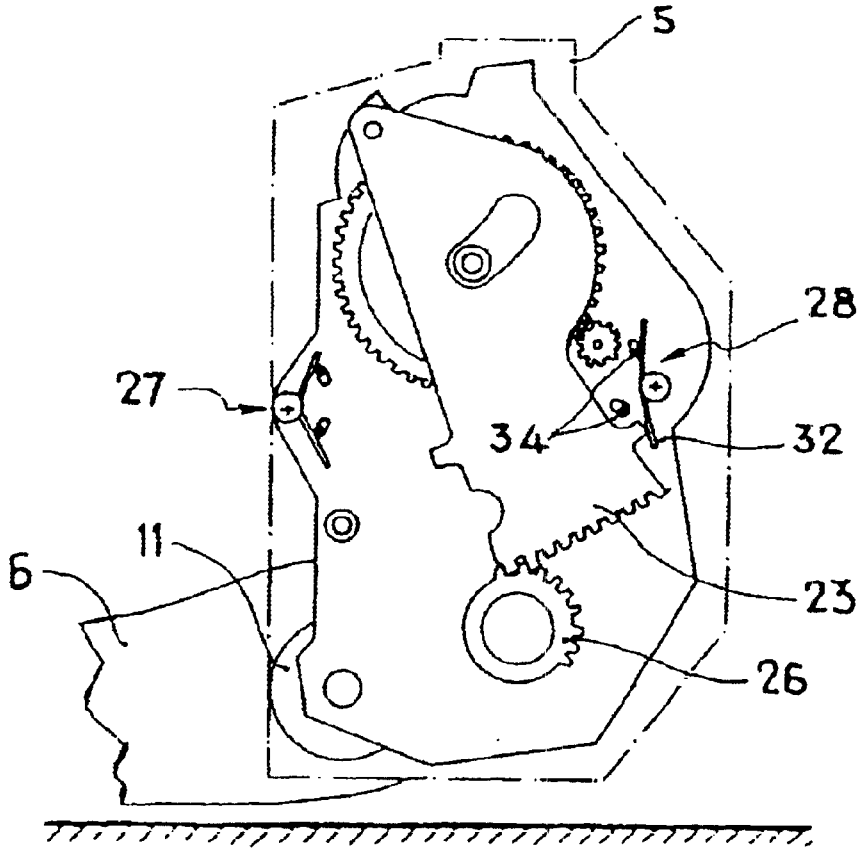

FIG. 9 shows a schematic sectional view of the mechanism, with the doll in the seated position.

Figure 10:
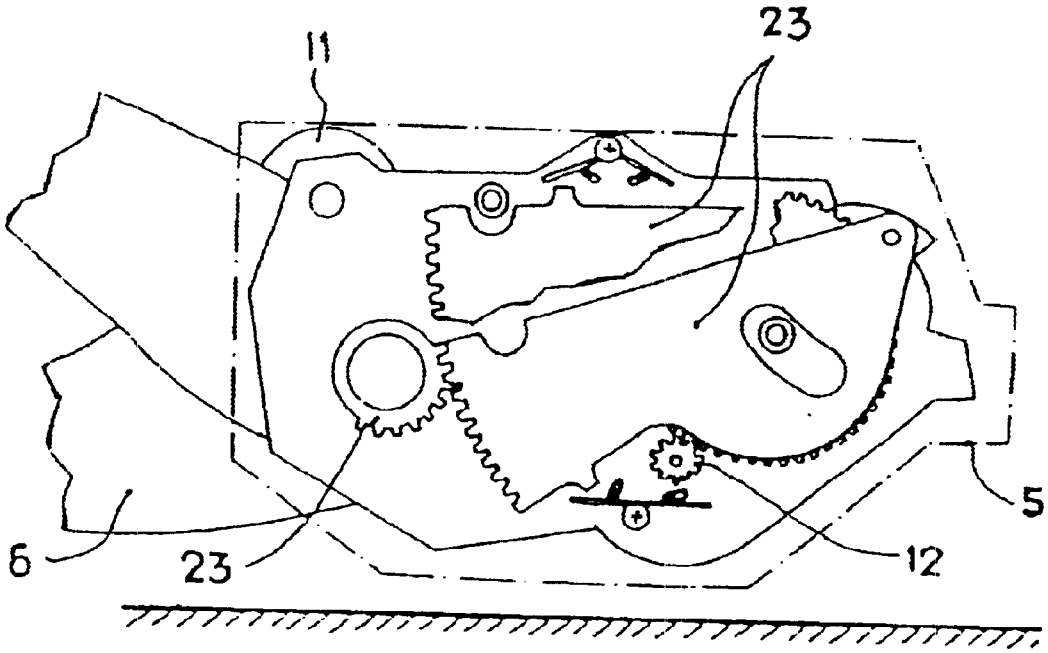

FIG. 10 shows a schematic sectional view of the mechanism with the doll laying down, but not in the extreme position of the oscillating levers.

Figure 11:
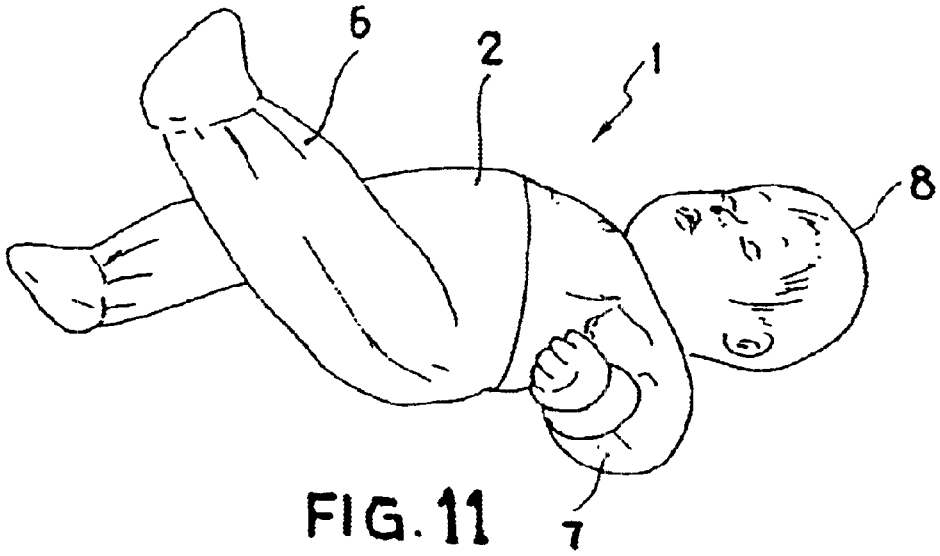

FIG. 11 shows a view of the doll corresponding to the position of the mechanism illustrated in FIG. 10.

Figure 12:
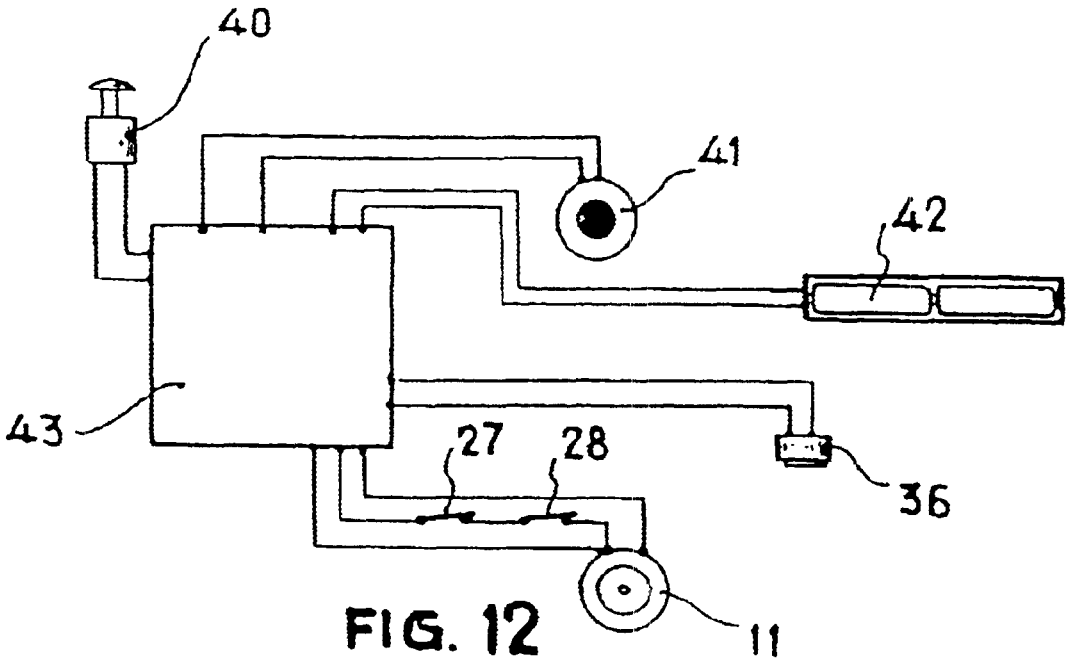

FIG. 12 shows a schematic of the doll's different electrical components.

Figure 13:
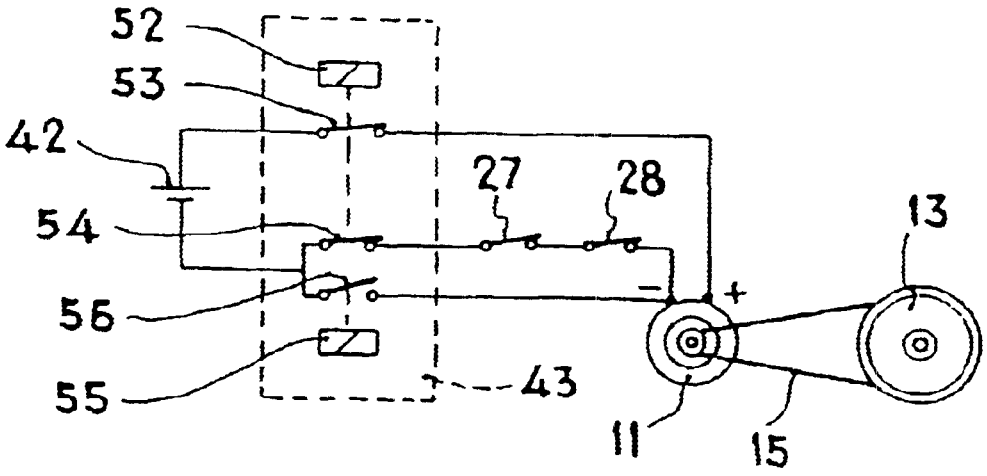

FIG. 13 shows a very simplified electrical schematic of the supply to the motor.

Figure 14:
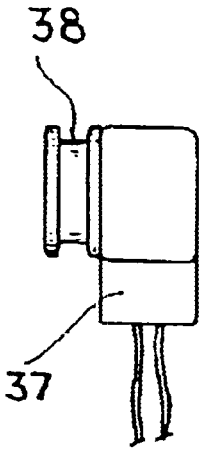

FIG. 14 shows a right side view of the microphone support.

Figure 15:
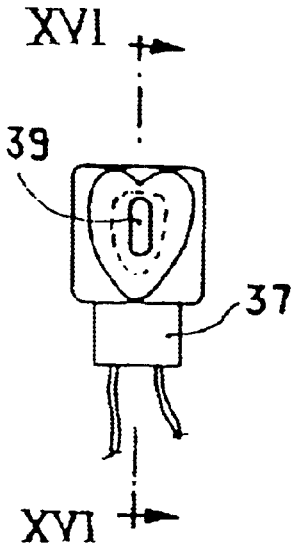

FIG. 15 shows a front view of the microphone support.

Figure 16:
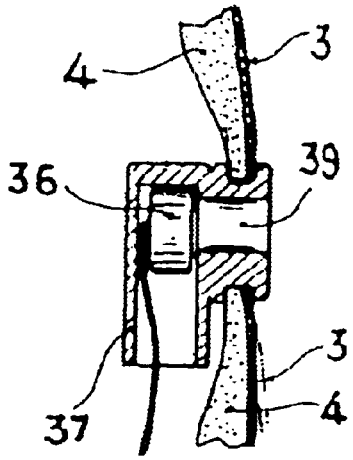

FIG. 16 shows a left side sectional view of the microphone support.

Figure 17:
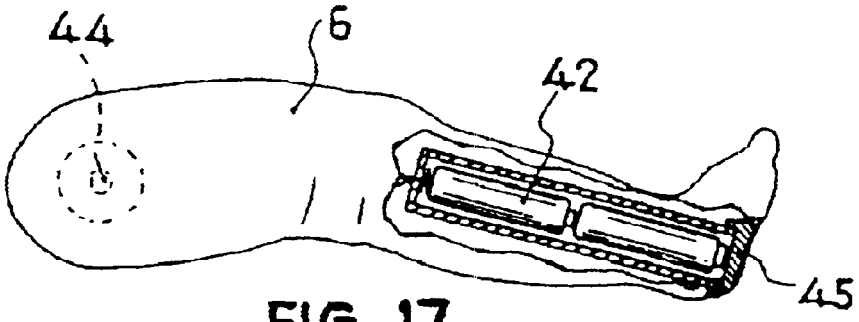

FIG. 17 shows a side view of the doll's right leg, with a partial sectional view to illustrate the location of the batteries.

Figure 18:
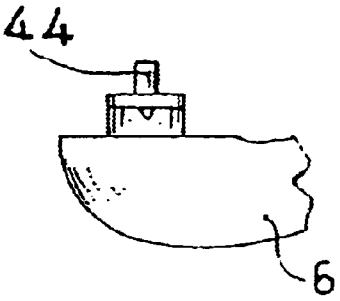

FIG. 18 shows a detailed plant view of the area of the articulation of the leg represented in FIG. 17.

In said figures, the number references correspond to the following parts and elements:

1. Doll
2. Trunk
3. Material wrapping
4. Foam rubber
5. Mechanism
6. Legs
7. Arms
8. Head
9. Head motion device (8)
10. Mechanism plates
11. Electrical motor
12. Central gear
13. Drive pulley
14. Following pulley
15. Belt
16. Intermediate wheel
17. Following pulley gear
18. Central gear wheel
19. Intermediate gear
20. Central wheel
21. Channels
22. Knobs
23. Oscillating levers
24. Articulation axle
25. Oscillating toothed area
26. Toothed circular area
27. Off switch in laying down position
28. Off switch in seated position
29. Laying down stop wire
30. Laying down stop axle
31. Laying down stop rivets
32. Seated stop wire
33. Seated stop axle
34. Seated stop rivets
35. Oscillating lever port (23)
36. Microphone
37. Sensor support
38. Groove
39. Frontal opening
40. Main switch
41. Loudspeaker
42. Batteries
43. Electronic board
44. Cut axle
45. Battery cover
46. Lower dish
47. Cross axle
48. Upper dish
49. Dish axle
50. Dish port
51. Dish stop
52. Main relay
53. Common switch
54. Closing switch
55. Alternative relay
56. Alternative switch As can be seen in FIGS. 1, 2, 3 and 4, the doll (1) object of the invention presents a trunk (2) constituted by a material wrapping (3) stuffed with foam rubber (4) which houses in its interior the mechanism (5), to which the legs (6) are united rotationally. The arms (7) do not move and they display a structure similar to that of the trunk (2) while the head (8) is united to it by means of a motion device (9) which will be described appropriately.

The mechanism (5) is shown in FIGS. 5, 6 and 7 and it basically consists of two mechanism plates (10) between which an electrical motor (11) is mounted which activates a central gear (12) by means of a drive pulley (13) attached to the shaft of the electrical motor (11), a following pulley (14), both connected by a belt (15), an intermediate wheel (16) which receives its movement from a following pulley gear (17) united to the following pulley (14) and a central gear wheel (18) united to the central gear (12) which receives its movement from an intermediate gear (19) united to the intermediate wheel (16). Arranged so as to gear into the central gear (12) is a central wheel (20) that has on each one of its sides matching channels (21) where two knobs (22) are housed which have two oscillating levers (23) arranged at each side of the central wheel (20) and that can revolve around an articulation axle (24) located near the doll's shoulders. Each oscillating lever (23) ends in the part farthest from the articulation axle (24) in an oscillating toothed area (25) which gears into a toothed circular area (26) united rotationally to the legs (6), as will be described appropriately.

In order to allow the movement of the oscillating levers (23) these have matching oscillating lever ports (35) through which the rotating shaft of the central wheel (20) passes.

As can be seen in FIGS. 5 and 6, assembled on the right side mechanism plate (10) is the unit of wheels and gears which constitute the reducer of the electrical motor (11), and assembled on the left side mechanism plate (10) there is an off switch in laying down position (27) consisting of a laying down stop wire (29) wound around a laying down stop axle (30) which rests elastically on two laying down stop rivets (31), as well as an off switch in seated position (28) consisting of a seated stop wire (32) wound around a seated stop axle (33) which rests elastically on two seated stop rivets (34). The off switches (27) (28) are connected electrically in series and through them, one of the motor's poles is fed, as can be seen in FIG. 13.

As a detection element of exterior stimulations there is a microphone (36) inserted tightly into a sensor support (37), which has a groove (38) that secures the foam rubber body (4) and the material wrapping (3) and thus ensure the transmission of the slightest touch from any part of the doll's body to the microphone (36). A frontal opening (39) picks up the speech directly. In the example represented as a preferred embodiment, the shape of a heart has been given to the visible part of the sensor support (37). See FIGS. 14, 15 and 16.

FIG. 12 shows the general schematic of connections of the different electrical components, consisting of a main switch (40), a loudspeaker (41) and a battery case (42), aside from the microphone (36) and the electric motor (11) already mentioned, all being connected to an electronic board (43).

In FIGS. 17 and 18 the cut axle (44) can be seen, which constitutes the element that allows to fasten, in a rotationally attached way, the legs (6) to the toothed circular areas (26), which is an absolutely conventional device. Other elements, also familiar to an expert in the field, have not been represented in an attempt to not complicate the description unnecessarily.

The motion device (9) of the head (8) consists of a lower dish (46) attached flexibly to the mechanism (5) by a cross axle (47) to the surrounding of which is attached the material wrapping (3) that constitutes the doll's (1) trunk (2), and an upper dish (48) that rotates around a dish axle (49) fastened to the lower dish (46) on which it rests. The side movement of the upper dish (48), and the head (8) attached to it, is limited by the dish port (50) on the upper dish (48) wherein there is a dish stop (51) attached to the lower dish (46). By this means the head moves freely from front to back, as well as to both sides when the doll (1) lays down or sits up, constituting a simple and economical motion device. See FIGS. 3 and 4.

The operation of the doll object of the invention is the following:

Once the main switch (40) has been activated, the doll will reach one of the two extreme positions, laying down or sitting up, and it will remain resting. This operation is produced as a consequence of the activation of a main relay (52) and the closing of a common switch (53) and a closing switch (54), with the electric motor (11) stopping when the doll reaches one of its extreme positions and the off switch in laying down position (27) or the off switch in seated position (28) is opened. See FIG. 13.

When the conventional detection circuit housed in the electronic board (43) detects a signal coming from the microphone (36) as a consequence of an exterior sound or touch stimulation, the alternative relay (55) is activated, which upon closing the alternative switch (56) supplies energy to the electric motor (11) even though one of the off switches (27) (28) remains open because of the doll being in one of its extreme laying down or seated positions. This energizing of the electric motor (11) is produced in the form of impulses of 2 seconds of duration and simultaneously unintelligible sounds are emitted from the loudspeaker (41).

In FIG. 8 can be seen a schematic of the mechanism (5) when the doll (1) is in its laying down position. The oscillating lever (23) has caused the off switch in laying down position (27) to open, by separating the laying down stop wire (29) from one of the laying down stop rivets (31), consequently interrupting the supply to the electric motor (11). The doll (1) will not be able to come out of this position unless it is as a consequence of the activation of the microphone (36) by means of an exterior sound or touch stimulation. Usually, the two second motor impulse produced will be insufficient for the movement of the oscillating lever (23) to withdraw sufficiently to allow the closing of the off switch in laying down position (27) which will thus require a series of successive stimulations until the closing of this contact is produced, at which time the supply to the electric motor (11) will not cease until the doll (1) reaches the position shown in FIG. 9 and the oscillating lever (23) causes the opening of the off switch in seated position (28). In this way it is simulated that the doll (1) does not respond immediately to the exterior stimulations, introducing into its behavior a pseudo random response.

The position of the two oscillating levers (23) with respect to the mechanism plates (10) is the same for the extreme positions represented in FIGS. 8 and 9 but, by means of an adequate design of the channels (21) of the central wheel (20), a perceptible lag can be attained in its movement. Thus, it has been established that during the laying down operation, it is advantageous that one of the legs, the left one in the example at hand, is kept behind. This, and also since in this leg there is only one battery instead of the two that are in the right leg, causes a destabilized fall, simulating that during the doll's (1) operation of laying down, it raises one leg to maintain a certain balance. At this time, both off switches (27) (28) are closed, since the doll has not reached its extreme position. See FIGS. 10 and 11.

Figure 1:
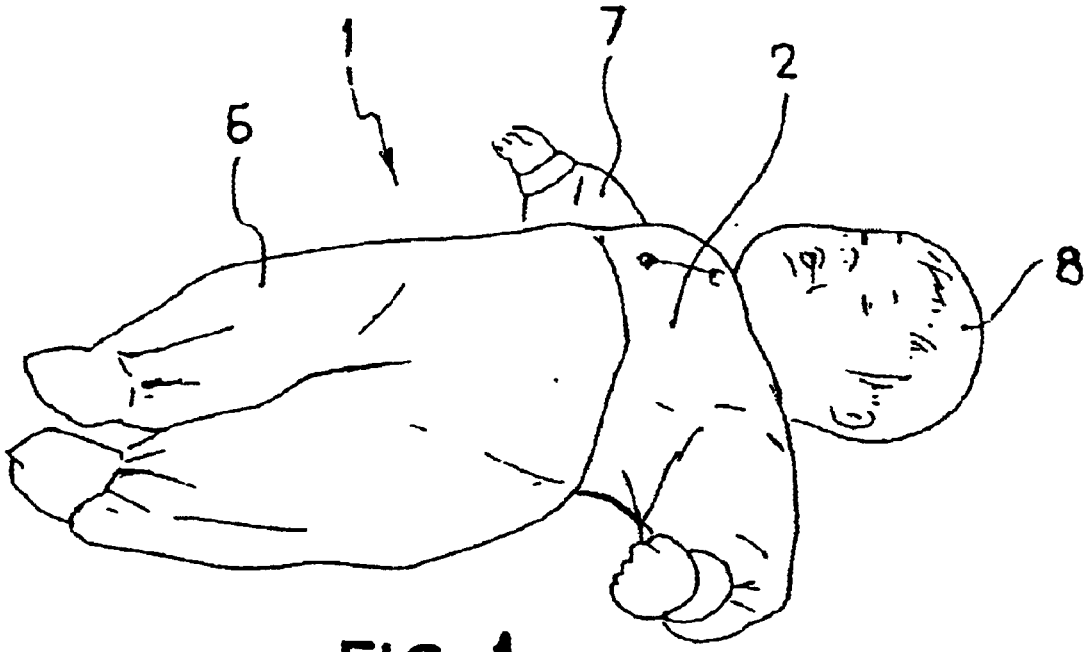
FIG. 1 shows a view of the doll of the invention laying down.
Figure 2:
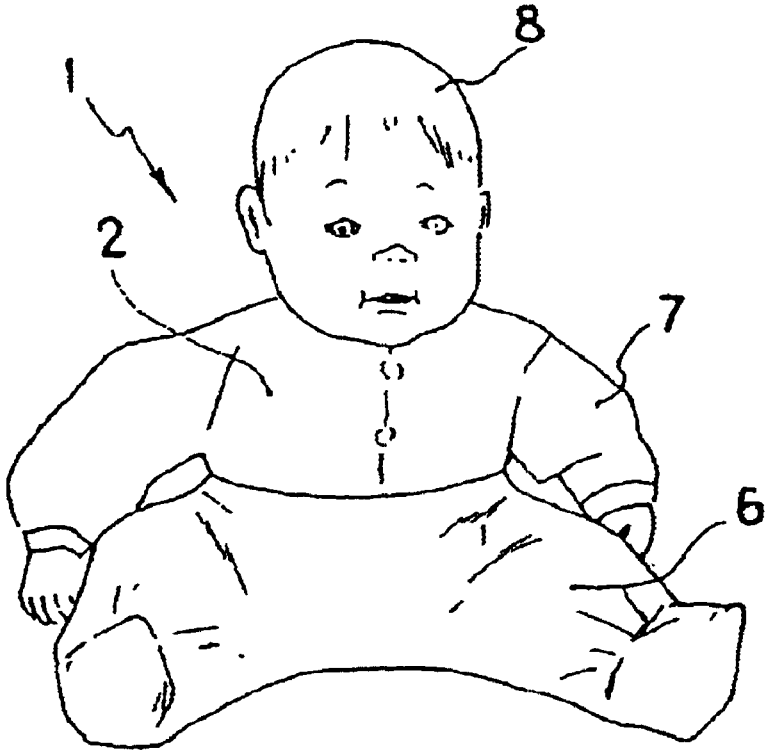
FIG. 2 shows a view of the doll of the invention sitting up.

Likewise, to obtain a greater realism, it can be observed in FIGS. 1 and 2 that the doll (1) lays down with its legs together, but it separates them when it sits up. This is attained simply with a downward and slightly backward inclination of the rotating axles of the toothed circular areas (26) and legs (6), as can be seen in FIG. 7, where the doll has been represented in a seated position with its legs (6) open.

The battery (42) case in the legs (6) is conventional, being possible to substitute the batteries after opening a battery cover (45) located at the base of the doll's (1) feet, as shown in FIG. 17.

What is claimed is:

1. A doll that reacts to voice and to caressing by moving between laying down and sitting up, said doll including a trunk that has arms and a head and flexible legs, said doll further having:

an electric motor, for activation, that turns in only one direction, a first control device for shutting off the electric motor, including a first off switch that is activated by moving to a laying down position and a second off switch that is activated by moving to a seated position with both said switches looped in series to said electric motor, so that an electrical supply circuit to the electric motor opens and said motor stops when said doll reaches an extreme position of laying down or sitting up, a second control device for start-up of said electric motor including a microphone capable of detecting both the voice sounds as well as a touch sounds that are produced by touching part of said doll, connected to an electronic board operably capable of activating said motor independently of the circuit that comprises the first off switch and the second off switch, a mechanical motion mechanism communicating with said trunk and said legs and connected to said motor to operably produce relative motion between said trunk and said legs upon activation of said motor.

2. The doll according to claim 1, wherein said body is constructed of foam rubber and said microphone is inserted tightly inside a sensor support having a groove arranged so as to secure said microphone within a material wrapping that covers at least part of said trunk of said doll.

3. The doll according to claim 1, wherein said motion mechanism comprises two plates with said motor attached therebetween, a central wheel and a pair of oscillating levers; said motor operably rotating said central wheel and said central wheel having a pair of channels with a respective channel being located on each side thereof; each of said oscillating levers have a knob with each knob being housed in a respective one of said channels; said central wheel operably rotating around an articulation axle located near shoulders of said doll; each of said oscillating levers having on a side thereof opposite to a respective articulation point thereof an oscillating toothed area that is geared to a curved toothed region of a structure connected to a respective one of said legs of said doll and operably rotating said respective leg.

4. The doll according to claim 3, wherein said motor is connected to a reducer; said reducer includes a drive pulley attached to an axle of said motor; said drive pulley receives a belt and said belt operably transmits movement from said motor to a following pulley attached to a following pulley gear; said pulley gear is geared to an intermediate wheel; said intermediate wheel has an intermediate gear and said intermediate gear is geared to a central gear wheel attached to a central gear; said central gear in turn is geared to said central wheel.

5. The doll according to claim 1, including batteries to supply energy to said motor, said batteries being operably located inside said legs, in order that said batteries, weigh said legs so that said legs are comparatively heavier than said trunk, such that said legs tend to remain motionless and resting on a surface supporting said doll and such that said trunk moves in one or the other direction until reaching the laying down position or the sitting up position relative to said legs.

6. The doll according to claim 1, including a head motion device located on said trunk; said head motion device having a lower dish attached flexibly to said motion mechanism by a cross axle and to a material wrapping that forms an exterior of at least a portion of said trunk; said head motion device further having an upper dish that rotates around a dish axle connected to said lower dish in such a manner so as to limit sideways movement of said upper dish to a width of a dish port that is located on said upper dish and rotation of said head being operably limited by a dish stop attached to said lower dish.

* * * * *